US009115457B2

(12) United States Patent
Yang

(10) Patent No.: US 9,115,457 B2
(45) Date of Patent: Aug. 25, 2015

(54) METHOD FOR WARNING OF RESIDUAL AMOUNT OF LIQUID DETERGENT

(75) Inventor: Jin Pyung Yang, Seoul (KR)

(73) Assignee: DONGBU DAEWOO ELECTRONICS CORPORATION, Seoul (KR)

( * ) Notice: Subject to any disclaimer, the term of this patent is extended or adjusted under 35 U.S.C. 154(b) by 148 days.

(21) Appl. No.: 13/981,108

(22) PCT Filed: Jan. 20, 2012

(86) PCT No.: PCT/KR2012/000534

§ 371 (c)(1),
(2), (4) Date: Jul. 23, 2013

(87) PCT Pub. No.: WO2012/102528

PCT Pub. Date: Aug. 2, 2012

(65) Prior Publication Data

US 2013/0314234 A1 Nov. 28, 2013

(30) Foreign Application Priority Data

Jan. 25, 2011 (KR) ..... 10-2011-0007287

(51) Int. Cl.
*G08B 21/00* (2006.01)
*D06F 33/02* (2006.01)

(52) U.S. Cl.
CPC ..... *D06F 33/02* (2013.01); *D06F 2202/02* (2013.01); *D06F 2204/10* (2013.01)

(58) Field of Classification Search
CPC ..... D06F 33/02
USPC ..... 340/612
See application file for complete search history.

(56) References Cited

U.S. PATENT DOCUMENTS

| | | | | |
|---|---|---|---|---|
| 7,802,335 | B2 * | 9/2010 | Hoppe et al. | 8/158 |
| 2010/0000264 | A1 * | 1/2010 | Luckman et al. | 68/4 |
| 2010/0125364 | A1 * | 5/2010 | Ebrom et al. | 700/275 |

FOREIGN PATENT DOCUMENTS

| | | | |
|---|---|---|---|
| JP | 2006-334204 | A | 12/2006 |
| KR | 10-2008-0092198 | A | 12/2008 |
| KR | 10-2008-0092200 | A | 12/2008 |
| KR | 20100081214 | A | 7/2010 |
| KR | 10-2011-0004748 | A | 1/2011 |

OTHER PUBLICATIONS

International Search Report; PCT /KR2012/000534; Int'l File Date: Jan. 20, 2012; Daewoo Electronics Corporation; 2 pgs.

* cited by examiner

*Primary Examiner* — Kerri McNally

(57) ABSTRACT

A method for warning of a residual amount of liquid detergent includes: calculating a total use amount of liquid detergent by adding up a use amount of liquid detergent whenever a washing process is performed; and comparing the total use amount of liquid detergent to a reference amount, and warning of a residual amount of liquid detergent according to the comparison result. Accordingly, a user does not need to frequently check the residual amount of liquid detergent, and may easily fill up a container with the liquid detergent. Furthermore, since a sensor for sensing the residual amount of liquid detergent is not installed, it is possible to reduce the manufacturing cost of the washing machine and to prevent a user from getting an electric shock from a current leaking to the container.

6 Claims, 3 Drawing Sheets

METHOD FOR WARNING OF RESIDUAL AMOUNT OF LIQUID DETERGENT

FIELD OF TECHNOLOGY

The following relates to a washing machine, and more particularly, to a method for warning of a residual amount of liquid detergent by determining the residual amount of liquid detergent based on a value calculated by adding up amounts of liquid detergent used for washing processes.

BACKGROUND

In general, a washing machine refers to a product that removes pollutants of clothes and bedclothes through emulsification of a detergent, friction of water flow caused by rotations of a pulsator, and impact applied by the pulsator.

The washing machine is divided into a top-loading type in which a washing tub is erected and a drum type in which a washing tub is laid, depending on the shape of the washing tub in which laundry is housed.

When a container of a washing machine is filled up with a liquid detergent easy to dilute and having an excellent emulsification function and a washing command is inputted, the washing machine supplies a preset amount of liquid detergent, and then automatically performs a series of processes including a washing process, a rinsing process, and a spin-drying process.

As a related art of the present invention, Korean Patent Laid-open Publication No. 10-2010-0081214 published on Jul. 14, 2010, has disclosed a washing machine and a sensing method for liquid detergent supply.

Since the conventional washing machine automatically supplies a liquid detergent during a washing process, a user must previously store the liquid detergent in the container before the washing process such that the washing machine does not lack the liquid detergent.

Therefore, the user must frequently check the residual amount of liquid detergent stored in the container, whenever using the washing machine.

Furthermore, since the conventional washing machine includes a plurality of sensors for sensing the residual amount of liquid detergent, the manufacturing cost increases, and a current flowing through the sensors may leak to the container. In this case, the user may get an electric shock.

SUMMARY

The present disclosure is conceived to solve such problems of the related art, and an aspect is to provide a method for warning of a residual amount of liquid detergent, which calculates a total use amount by adding up amounts of liquid detergent used for washing processes, determines a residual amount of liquid detergent based on the calculated total use amount, and warns of the residual amount depending on the determination result.

Another aspect is to provide a method for warning of a residual amount of liquid detergent, which automatically warns a residual amount of liquid detergent stored in a container such that a user does not need to frequently check the residual amount of liquid detergent and easily supplies liquid detergent.

According to another aspect, a method for warning of a residual amount of liquid detergent includes: calculating a total use amount of liquid detergent by adding up a use amount of liquid detergent whenever a washing process is performed; and comparing the total use amount of liquid detergent to a reference amount, and warning of a residual amount of liquid detergent according to the comparison result.

The warning of the residual amount of liquid detergent may include warning of the residual amount of liquid detergent when the total use amount of liquid detergent is equal to or more than the reference amount.

The use amount of liquid detergent may be set according to one or more of a washing course, a laundry amount, a liquid detergent control command, and a washing water amount.

The method may further include displaying the number of additional washing processes to be performed, after the warning of the residual amount of liquid detergent.

The number of additional washing processes to be performed is calculated by dividing the residual amount of liquid detergent by an average use amount of liquid detergent.

The average use amount of liquid detergent may be calculated by dividing the total use amount of liquid detergent by the number of performed washing processes.

The reference amount may be set according to an initial amount of liquid detergent when a container is filled up with the liquid detergent.

According to the embodiment of the invention, since a warning for a residual amount of liquid detergent is automatically issued, a user does not need to frequently check the residual amount of liquid detergent, and may easily fill up a container with the liquid detergent.

Furthermore, since a sensor for sensing the residual amount of liquid detergent is not installed, it is possible to reduce the manufacturing cost of the washing machine and to prevent a user from getting an electric shock from a current leaking to the container.

BRIEF DESCRIPTION

The above and other aspects, features and advantages of the invention will become apparent from the following detailed description in conjunction with the accompanying drawings, in which.

DETAILED DESCRIPTION

Embodiments of the invention will hereinafter be described in detail with reference to the accompanying drawings. It should be noted that the drawings are not to precise scale and may be exaggerated in thickness of lines or sizes of components for descriptive convenience and clarity only. Furthermore, the terms as used herein are defined by taking functions of the invention into account and can be changed according to the custom or intention of users or operators. Therefore, definition of the terms should be made according to the overall disclosures set forth herein.

A method for warning of a residual amount of liquid detergent is performed as follows: amounts of liquid detergent used for washing processes are added up to calculate a total use amount, the calculated total use amount is compared to a reference amount, and a warning for the residual amount of liquid detergent is issued according to the comparison result.

Here, the total use amount of liquid detergent is calculated by adding up the amount of liquid detergent used whenever a washing process is performed.

An amount of liquid detergent to be used (hereafter, referred to as use amount of liquid detergent) is preset according to the amount of laundry. However, the use amount of liquid detergent may be additionally set for each washing course selected by a user, directly set by the user, or set according to a washing water amount selected by the user.

After a warning for the residual amount of liquid detergent is issued, an average use amount of liquid detergent is calculated. Then, based on the calculated average use amount, the number of washing processes which can be additionally performed by the residual amount of liquid detergent is calculated and displayed.

Figure 1:
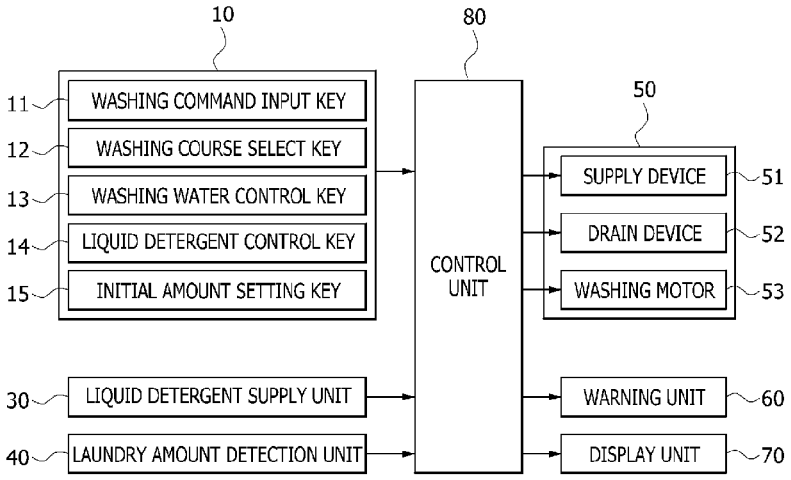
FIG. 1 is a block configuration diagram of a washing machine in accordance with an embodiment of the present invention.

FIG. 1 is a block configuration diagram of a washing machine in accordance with an embodiment of the present invention.

The washing machine in accordance with the embodiment of the present invention includes a key input unit 10, a liquid detergent supply unit 30, a laundry amount detection unit 40, a washing device 50, a warning unit 60, a display unit 70, and a control unit 80.

The key input unit 10 is configured to receive various control commands from a user. The key input unit 10 includes a washing command input key 11, a washing course select key 12, a washing water control key 13, a liquid detergent control key 14, and an initial amount setting key 15.

The washing command input key 11 is configured to input a washing command. The washing command selectively performs one or more of a washing process, a rinsing process, a spin-drying process, and a drying process or continuously performs a preset series of washing courses.

In this specification, a case in which a washing process using liquid detergent is performed when the washing command input key 11 is inputted will be taken as an example for description.

The washing course select key 12 is configured to input a washing course select command for selecting a washing course. The washing course may include a standard washing course in which a series of processes including a washing process, a rinsing process, and a spin-drying process are automatically performed. In addition, the washing course may include a lingerie washing course, a wool washing course, a sports shoes washing course and the like, depending on the type and material of the laundry.

The washing course is not limited to the above-described examples, but may be further subdivided into various washing courses. Therefore, the scope of the present invention may include all washing courses provided by the washing machine.

Meanwhile, the use amount of liquid detergent is set in various manners depending on the washing courses. Therefore, when a user inputs a washing course select command through the washing course select key 12, the liquid detergent is supplied according to the use amount of liquid detergent, which is set in the selected washing course.

For reference, a washing water amount is preset for each of the washing courses. Therefore, the washing water amount set for the selected washing course is supplied to perform a washing process. However, the washing water amount may be separately controlled.

The washing water control key 13 is configured to input a washing water control command for controlling the washing water amount. Through the washing water control key 13, a user may arbitrarily control the washing water amount. Furthermore, although a washing course is selected to set a washing water amount, the washing water amount may be additionally controlled.

Here, the washing water amount may be set is various manners such as large amount, medium amount, and small amount.

The liquid detergent control key 14 is configured to input a liquid detergent control command for controlling the amount of liquid detergent used in the washing process. Through the liquid detergent control key 14, the user may arbitrarily control the use amount of liquid detergent. Furthermore, although a washing course is selected to set the use amount of liquid detergent, the use amount of liquid detergent may be additionally controlled.

In this case, whenever the liquid detergent control key 14 is inputted once, the use amount of liquid detergent may be increased or decreased by a predetermined amount, or any one of a plurality of preset liquid detergent supply amounts may be selected, and the liquid detergent may be supplied by the selected amount.

The initial amount setting key 15 is configured to set an initial amount of liquid detergent supplied to a container (not illustrated), when the container is filled up with the liquid detergent.

The initial amount refers to an initial amount of liquid detergent supplied to the container by a user when the container is filled up with the liquid detergent, and is set by the user. The initial amount may include a plurality of initial amounts, and the user sets an initial amount corresponding to the amount of liquid detergent supplied by the user.

For example, when the container is filled up with liquid detergent, the initial amount is set to the highest amount, and when the container is filled with a smaller amount of liquid detergent than the highest amount, the initial amount may be set to the second highest amount.

Therefore, a separate sensor for sensing liquid detergent does not need to be provided.

The liquid detergent supply unit 30 opens or closes a valve (not illustrated) installed in the container, and supplies the liquid detergent stored in the container to a washing tub. In this case, the liquid detergent supply unit 30 supplies liquid detergent by a use amount set according to a laundry amount, or additionally supplies liquid detergent by a use amount set according to a washing course select command, a washing water control command, or a liquid detergent control command.

The washing device 50 includes a water supply device 51, a drain device 52, and a washing motor 53.

The water supply device 51 supplies washing water to the washing tub (not illustrated). The water supply device 51 includes a water supply tube (not illustrated) and a water supply valve (not illustrated). The water supply tube has one side to a water supply unit (not illustrated) to supply cold water and hot water and the other end connected to the washing tub, thereby forming a flow path through which washing water supplied from the water supply unit is transferred to the washing tub. The water supply valve is installed in the water supply tube so as to control the washing water.

The drain device 52 includes a drain tube (not illustrated), a drain valve (not illustrated), and a drain pump (not illustrated). The drain tube has one side connected to the washing tub and the other side connected to communicate with the outside of the washing machine, thereby forming a flow path through which the washing water of the washing tub is drained to the outside of the washing machine. The drain valve is installed in the drain tube so as to control washing water. The drain pump forces washing water to be drained to the outside of the washing machine through the washing tube.

The washing motor 53 rotates the washing tub in a forward or backward direction to wash the laundry. Typically, a driving force generated by the washing motor 53 is transmitted to the washing tub through a power transmission device (not illustrated) including a gear or transmission belt.

The above-described washing device 50 is not limited to the washing device 51, the drain device 52, and the washing motor 53, but may further include various devices such as a heater to heat washing water.

The warning unit 60 warns of the residual amount of liquid detergent. The warning unit 60 warns of the residual amount through a buzzer sound or a display (not illustrated) provided on a front panel of the washing machine.

The display unit 70 displays the number of additional washing processes to be performed. The display unit 70 is installed on the front panel of the washing machine such that a user may easily recognize the number of additional washing processes to be performed. The display unit 70 may include a light emitting diode (LED) or liquid crystal display (LCD).

Here, the number of additional washing processes to be performed indicates an expected number of washing processes which can be performed by the residual amount of liquid detergent, after the warning unit 60 warns of the residual amount of liquid detergent.

The control unit 80 calculates a total use amount by adding up the amounts of liquid detergent used for washing processes in a state where the initial amount is set, compares the calculated total use amount to the reference amount, and warns of the residual amount depending on the comparison result.

Here, the reference amount refers to an amount serving as a reference value for warning that the residual amount of liquid detergent is insufficient. The reference amount is set in such a manner that the amount of liquid detergent remaining in the container based on the initial amount is equal to or more than the amount of liquid detergent used for at least one washing process. That is, even after a warning is issued because the total use amount of liquid detergent is equal to or larger than the reference amount, a washing process may be additionally performed.

Therefore, when a user performs the next washing process, the user may not lack the liquid detergent. At this time, the user may be induced to fill up the container with the liquid detergent.

Hereafter, the method for warning of a residual amount of liquid detergent in accordance with the embodiment of the present invention will be described with reference to FIGS. 2 to 6.

Figure 2:
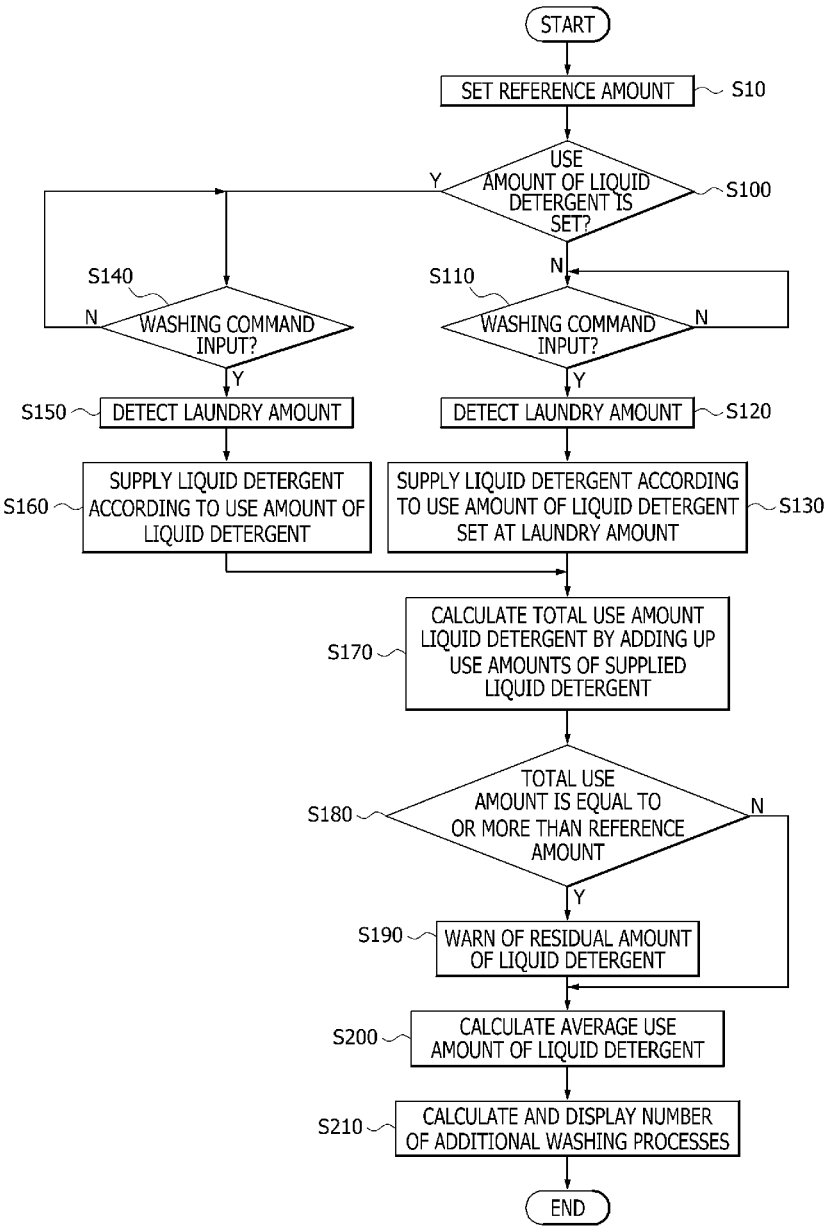
FIG. 2 is a flowchart showing a method for warning of a residual amount of liquid detergent in accordance with the embodiment of the present invention.
Figure 3:
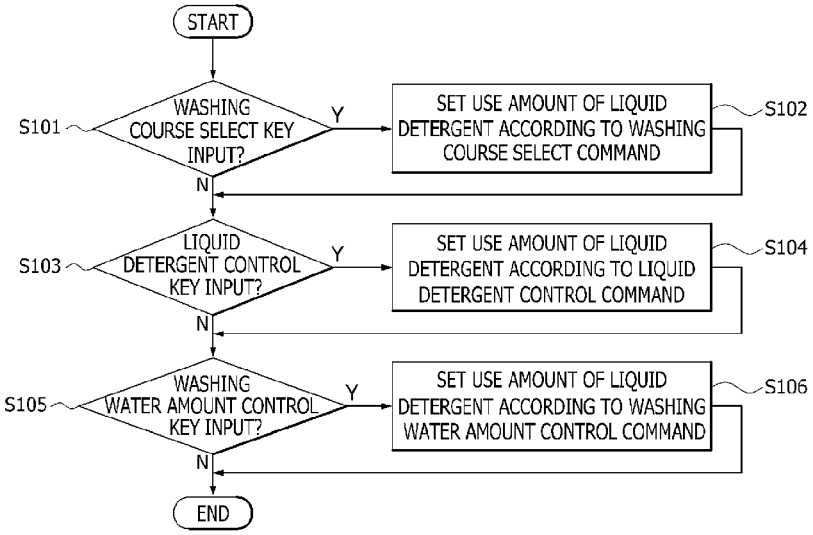
FIG. 3 is a flowchart showing a process of controlling a use amount of liquid detergent in FIG. 2.
Figure 4:
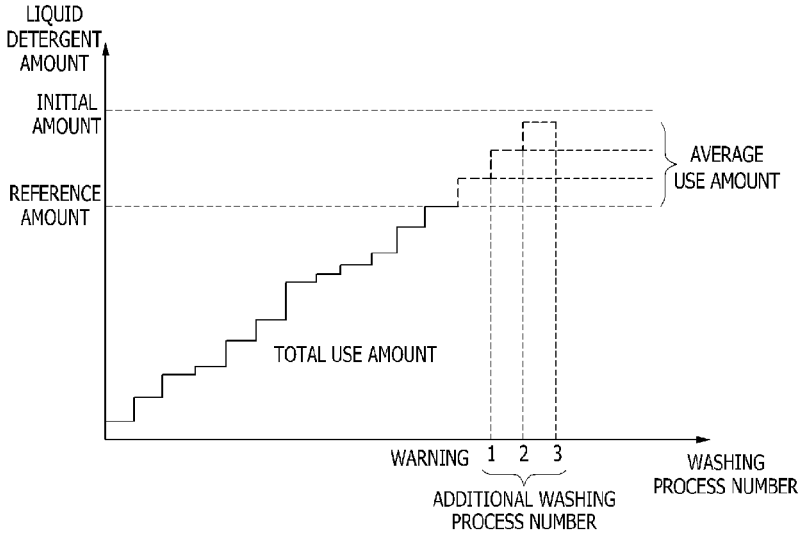
FIG. 4 is a graph illustrating a reference amount and a warning time point in accordance with the embodiment of the present invention.

FIG. 2 is a flowchart showing the method for warning of a residual amount of liquid detergent in accordance with the embodiment of the present invention. FIG. 3 is a flowchart showing a process of controlling the use amount of liquid detergent in FIG. 2. FIG. 4 is a graph illustrating the reference amount and a warning time point in accordance with the embodiment of the present invention.

Referring to FIG. 2, an initial amount corresponding to the amount of liquid detergent supplied to the container is set through the initial amount setting key 15, and a reference amount is set according to the initial amount, at step S10.

At this time, the reference amount is set in such a manner that the amount of liquid detergent remaining in the container based on the initial amount is equal to or more than the amount of liquid detergent used for at least one washing process.

In such a state where the reference amount is set, the amount of liquid detergent to be used during the washing process may be set at step S100.

The process of setting the use amount of liquid detergent will be described with reference to FIG. 3.

First, when the washing course select key 12 is inputted at step S101, the use amount of liquid detergent is set according to the input washing course select command at step S102.

In this case, the use amount of liquid detergent is preset for each washing course. When a specific washing course is selected, the amount of liquid detergent to be used for the corresponding washing process is set to the preset amount of liquid detergent to be used for the corresponding washing course.

Meanwhile, when the liquid detergent control key 14 is inputted at step S103, the use amount of liquid detergent is set according to the input liquid detergent control command at step S104. In this case, the use amount of liquid detergent is increased or decreased according to the liquid detergent control command. The use amount of liquid detergent may be increased or decreased by a predetermined amount whenever the liquid detergent control key is inputted once, or may be set to any one of a large amount, a medium amount, and a small amount.

On the other hand, when the washing water amount control key is inputted at step S105, the use amount of liquid detergent is set according to the input washing water amount control key at step S106. In this case, the use amount of liquid detergent is increased or decreased depending on the washing water amount. As the washing water amount is increased, the use amount of liquid detergent is increased, and as the washing water amount is decreased, the use amount of liquid detergent is decreased.

Furthermore, although a washing course is selected, the use amount of liquid detergent which is set for the washing course may be additionally changed according to a liquid detergent control command, when the liquid detergent control command is inputted.

Furthermore, although a washing course is selected, the use amount of liquid detergent which is set for the washing course may be additionally changed according to a washing water control command, when a washing water control command is inputted.

Furthermore, although a washing course is selected, the use amount of liquid detergent which is set for the washing course may be additionally changed according to a liquid detergent control command and a washing water control command, when a liquid detergent control command and a washing water control command are inputted.

Therefore, a user may select a washing course, and then input the liquid detergent control key 14 and/or the washing water control key, thereby performing a washing process according to the washing course, a washing water amount, and the use amount of liquid detergent which are suitable for the user's taste.

As described above, after the use amount of liquid detergent is set, whether or not a washing command is inputted through the washing command input key 11 is checked at step S140.

When the washing command is inputted, the laundry amount is detected through the laundry amount detection unit 40 at step S150.

Here, when the laundry amount is detected, various data required for performing the selected washing course are set.

Then, according to the use amount of liquid detergent which was set at the use amount setting process S100, the liquid detergent is supplied at step S160.

Then, a washing process is performed by the washing device 50. Here, since the process of performing a washing process using the washing device 50 may be easily understood by those skilled in the art, the detailed descriptions thereof are omitted herein.

Meanwhile, the control unit 80 calculates a total use amount of liquid detergent by adding up the supplied amounts of liquid detergent, at step S170.

When the total use amount of liquid detergent is calculated, the total use amount of liquid detergent is compared to the preset reference amount so as to determine whether the total use amount of liquid detergent is equal to or more than the reference amount, at step S180.

As a determination result, when the total use amount of liquid detergent is equal to or more than the reference amount, the control unit 80 controls the warning unit 60 to issue a warning for the residual amount of liquid detergent at step S190.

Meanwhile, when the total use amount of liquid detergent is less than the reference amount, whether or not to perform the next washing process is checked.

When the use amount of liquid detergent is not set at the use amount setting process S100, whether or not a washing command is inputted through the washing command input key 11 is checked at step S110.

When the washing command input key 11 is inputted, a laundry amount is detected through the laundry amount detection unit 40 at step S120, a washing water amount and a use amount of liquid detergent are set according to the detected laundry amount, and the set amount of liquid detergent is supplied by the liquid detergent supply unit 30.

Then, the washing device 50 is controlled to perform a washing process.

Meanwhile, after the liquid detergent is supplied, the total use amount of supplied liquid detergent is calculated at step S170, and whether the total use amount of liquid detergent is equal to or more than the reference amount is determined at step S180. As a determination result, when the total use amount of liquid detergent is equal to or more than the reference amount, a warning for the residual amount of liquid detergent is issued by the warning unit 60 at step S190.

As such, after the warning is issued, the average use amount of liquid detergent is calculated by dividing the total use amount of liquid detergent by the number of performed washing processes at step S200.

When the average use amount of liquid detergent is calculated, the number of additional washing processes to be performed is calculated by dividing the residual amount of liquid detergent by the average use amount, and then displayed through the display unit 70 at step S210.

At this time, the residual amount of liquid detergent is set based on the initial amount when the reference amount is set.

Therefore, the number of washing process which can be performed by the amount of liquid detergent remaining in the container may be expected.

That is, as illustrated in FIG. 4, when the total use amount is equal to or more than the reference amount lower than the initial amount, a warning is issued. However, it can be seen that the amount of liquid detergent remaining in the container corresponds to an amount of liquid detergent by which three additional washing processes can be performed.

Meanwhile, when and the user fills up the container with liquid detergent and inputs the initial amount setting key 15 after a warning for the residual amount of liquid detergent is issued by the warning unit 60, the total use amount of liquid detergent and the average use amount which have been calculated so far are initialized, and a reference amount is reset according to the set initial amount.

Although some embodiments have been provided to illustrate the invention in conjunction with the drawings, it will be apparent to those skilled in the art that the embodiments are given by way of illustration only, and that various modifications and equivalent embodiments can be made without departing from the spirit and scope of the invention. The scope of the invention should be limited only by the accompanying claims.

The invention claimed is:

1. A method for warning of a residual amount of liquid detergent, comprising:

calculating, by a control unit, a total use amount of liquid detergent by adding up a use amount of liquid detergent whenever a washing process is performed; and comparing, by a control unit, the total use amount of liquid detergent to a reference amount, and warning of a residual amount of liquid detergent according to the comparison result, wherein the use amount of liquid detergent is set according to one or more of a washing course, a laundry amount, a liquid detergent control command, and a washing water amount.

2. The method of claim 1, wherein the warning of the residual amount of liquid detergent comprises warning of the residual amount of liquid detergent when the total use amount of liquid detergent is equal to or more than the reference amount.

3. The method of claim 1, further comprising displaying a number of additional washing processes to be performed, after the warning of the residual amount of liquid detergent.

4. The method of claim 3, wherein the number of additional washing processes to be performed is calculated by dividing the residual amount of liquid detergent by an average use amount of liquid detergent.

5. The method of claim 4, wherein the average use amount of liquid detergent is calculated by dividing the total use amount of liquid detergent by the number of performed washing processes.

6. The method of claim 1, wherein the reference amount is set according to an initial amount of liquid detergent when a container is filled up with the liquid detergent.

* * * * *